United States Patent [19]

Mezger et al.

[11] Patent Number: 4,762,095

[45] Date of Patent: Aug. 9, 1988

[54] DEVICE FOR ACTUATING A FUEL-EXCHANGE POPPET VALVE OF A RECIPROCATING INTERNAL-COMBUSTION ENGINE

[75] Inventors: Hans Mezger, Freiberg; Reinhard Könneker, Mönsheim; Hans-Joachim Esch, Heimsheim, all of Fed. Rep. of Germany

[73] Assignee: Dr. Ing. h.c.F. Porsche Aktiengesellschaft, Stuttgart, Fed. Rep. of Germany

[21] Appl. No.: 50,391

[22] Filed: May 18, 1987

[30] Foreign Application Priority Data

May 16, 1986 [DE] Fed. Rep. of Germany ..... 3616540

[51] Int. Cl.[4] ..... F01L 9/04

[52] U.S. Cl. ..... 123/90.11; 123/90.65; 123/90.24; 123/90.12; 123/90.4

[58] Field of Search ..... 123/90.11, 90.22, 90.23, 123/90.24, 90.25, 90.4, 90.12, 90.14, 90.65, 90.66, 90.39; 251/337, 51; 137/129.1

[56] References Cited

U.S. PATENT DOCUMENTS

| | | | |
|---|---|---|---|
| 1,549,636 | 8/1925 | Hacht | 123/90.24 |
| 2,041,539 | 5/1936 | Gaultier . | |
| 2,401,480 | 6/1946 | Halliday | 123/90.65 |
| 2,534,621 | 12/1950 | Panhard | 123/90.65 |
| 2,819,705 | 1/1958 | Dickson . | |
| 3,358,659 | 12/1967 | Renger | 123/90.65 |
| 3,633,556 | 1/1972 | Inoue | 123/90.4 |
| 3,683,874 | 8/1972 | Berlyn | 123/90.12 |
| 3,882,833 | 5/1975 | Longstaff et al. | 123/90.11 |
| 4,269,388 | 5/1981 | Seilly et al. | 123/90.11 |
| 4,593,658 | 6/1986 | Moloney | 123/90.11 |

FOREIGN PATENT DOCUMENTS

| | | |
|---|---|---|
| 0118591 | 2/1986 | European Pat. Off. . |
| 1120804 | 12/1961 | Fed. Rep. of Germany . |
| 2057667 | 6/1972 | Fed. Rep. of Germany . |
| 2377525 | 8/1978 | France . |
| 0103907 | 6/1984 | Japan . |
| 0288749 | 4/1928 | United Kingdom . |
| 2137420 | 10/1984 | United Kingdom . |

*Primary Examiner*—Willis R. Wolfe
*Assistant Examiner*—M. Macy
*Attorney, Agent, or Firm*—Barnes & Thornburg

[57] ABSTRACT

A fuel-exchange poppet valve of a reciprocating internal-combustion engine is actuated by two electromagnets that, in an alternating way, are energized periodically to attract an armature disk arranged between them. The armature disk is fastened at an armature that is coupled to a one-armed fuel-exchange poppet valve control lever. The control lever is pivotally moved back and forth against the spring tension of a torsional bar spring to open and close a poppet valve.

18 Claims, 4 Drawing Sheets

DEVICE FOR ACTUATING A FUEL-EXCHANGE POPPET VALVE OF A RECIPROCATING INTERNAL-COMBUSTION ENGINE

BACKGROUND AND SUMMARY

The invention relates to a device for actuating a fuel exchange valve of a reciprocating internal-combustion engine that is developed as a poppet valve. The invention is particularly directed to improvements in such devices where the poppet valve is moved between the open and closed positions against restoring spring forces.

A valve actuating device of this general type is known from European Patent (EP-PS) No. 0 118 591. Two electromagnets that are excited with respect to one another in a phase-shifted way form an oscillating system with two coil springs that, on both sides, rest against an armature disk attracted by the electromagnets. The poppet valve that is connected with the armature disk is moved back and forth in response to this oscillation and in the process opens or closes a fluid passage opening. When a device of this type is used for actuating a fuel-exchange poppet valve of a reciprocating internal-combustion engine, it is important that the mass of the spring system be kept as small as possible in order to, on the one hand, maintain a precise control over the whole speed range of the internal-combustion engine and, on the other hand, limit the energy requirement for the electromagnets to a minimal quantity.

It is therefore an objective of the invention to provide an electromagnetic actuating of the valve that works against the force of a spring and has moving spring masses that are as small as possible.

This objective is achieved by utilizing a torsion bar spring acting on the valve control lever. The torsion bar spring that is used for the actuating of the valve has no oscillating masses that negatively influence the oscillating system. Also the rocker lever that is connected rigidly with the torsion bar spring and is in operative connection with the poppet valve has only a very small reduced mass so that the armature coupled to the valve lever almost without inertia can follow the alternate excitations of the electromagnets and can control the poppet valve correspondingly.

A similar torsion bar spring is known from German Published Examined Application (DE-AS) No. 1 120 804 for a purely mechanical valve control that is actuated by a cam. However, the use of a torsion bar spring for an electromagnetic valve control has the decisive advantage that it becomes only properly effective by means of the elimination of the translationally moved spring masses and the corresponding reduction of the forces of inertia and with a still acceptable expenditure of energy, it can be operated for the electricity supply of the electromagnets.

In an advantageous development of the preferred embodiments of the invention, the torsion bar spring, at one of its ends, is connected in a torsionally fixed way with the valve control lever and is disposed in two bearing brackets that are arranged on both sides of the valve lever; while at the other end, the torsion bar, in a torsionally fixed way, is clamped into a holding bush that is screwed together with the cylinder head. The armature that is disposed so that it can be moved longitudinally centrically with respect to the two electromagnets is coupled to the valve lever in such a way that its distance to the logitudinal axis of the poppet valve is considerably smaller than its distance to the longitudinal axis of the torsion bar or the bearing center of the valve lever. In this way, an adapted path translation can be achieved, from the valve lift of the poppet valve optimized according to thermodynamic aspects to the lifting motion of the armature that is useful for commercially available electromagnets.

Since the end positions of these two lifting motions always have tolerances that are caused by manufacturing, but since, on the other hand, a tight closing of the poppet valve is absolutely necessary also when the armature disk rests against one electromagnet, it is advantageous to provide an elastically flexible connection between the free end of the valve lever and the shaft of the poppet valve. For this purpose, the fork-shaped end of the valve control lever engages between a pressure disk resting on a shoulder of the valve shaft and a sliding sleeve that is guided longitudinally on the valve shaft, said sliding sleeve, by means of a coil spring, being supported against a holding bush fastened at the end of the valve shaft.

In order to dampen the impact of the valve disk on the valve seat when the poppet valve is closed, a hydraulic damping device is arranged above the valve shaft in the cylinder head. Several damping disks are disposed in an oil-filled cylindrical damping space. When the damping sleeve that is fastened at the upper end of the valve shaft penetrates into the damping space, the oil that is located between the damping disks is displaced through defined throttling spaces and thus causes a softer, quieter placing of the valve disk on the valve seat.

Other objects, advantages and novel features of the present invention will become apparent from the following detailed description of the invention when considered in conjunction with the accompanying drawings.

DETAILED DESCRIPTION OF THE DRAWINGS

Figure 1:
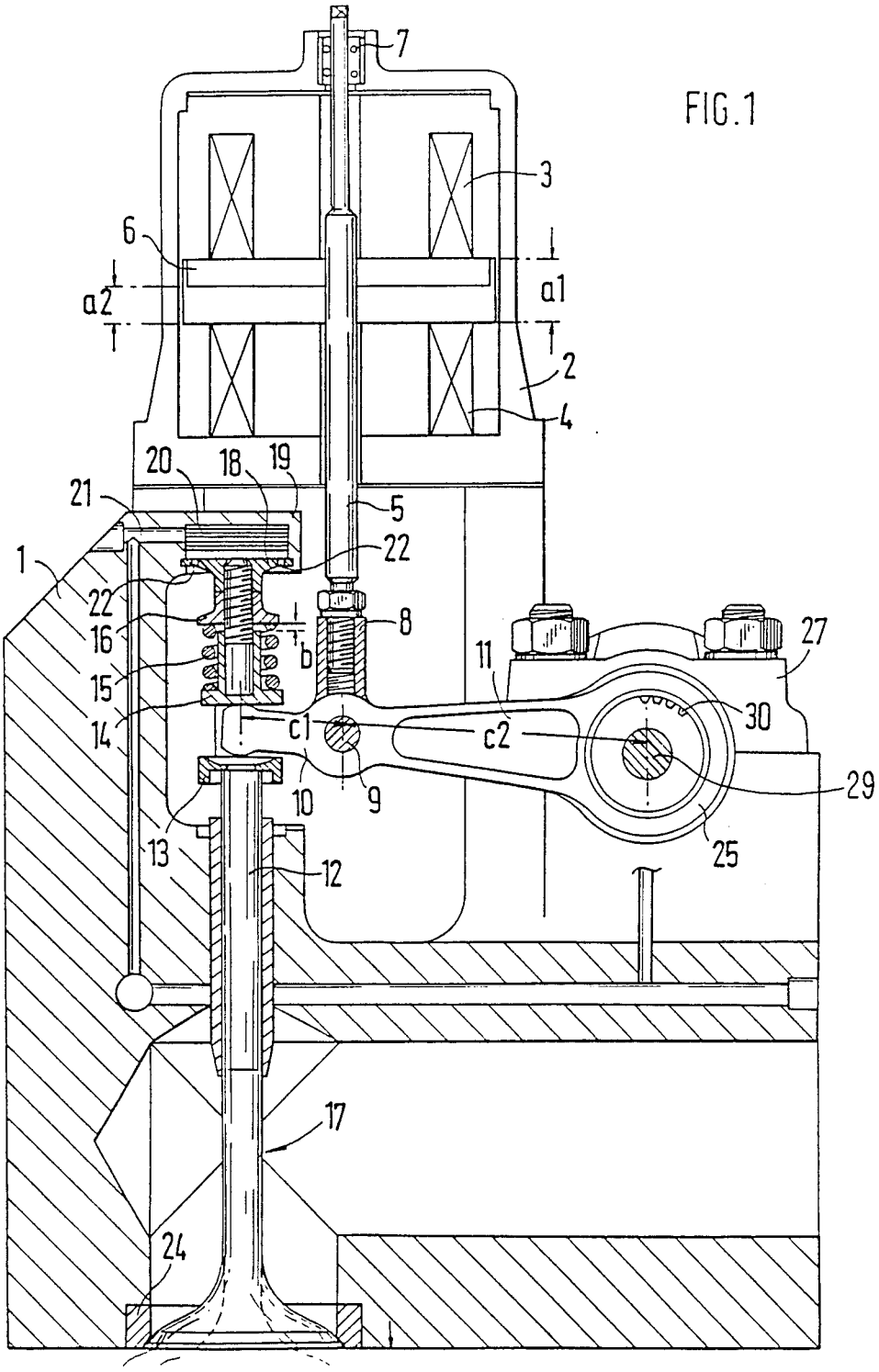
FIG. 1 is a front schematic view of a valve control device constructed according to a preferred embodiment of the invention, with a longitudinal sectional view through the poppet valve.

A magnet housing 2 is fastened at the cylinder head 1 of a reciprocating internal-combustion engine, a first electromagnet 3 and a second electromagnet 4 being firmly mounted in said magnet housing 2 at a distance al from one another. In the free space between the electromagnets 3 and 4, an armature disk 6 is disposed that is fastened at an armature 5, said armature disk 6 being pulled to the respective excited electromagnet 3 or 4. At its free end, the armature 5 is disposed in a bearing 7 of the magnet housing 2. The other end of the armature 5 is screwed into a rod head 8 that, by means of a pin 9, is coupled to a fork means 10 of a one-armed valve control lever 11; the evenly milled-off rod head 8 in this case being disposed between the form means 10 with lateral play.

The front end of the fork 10 reaches between a pressure disk 13 resting on a shoulder of the valve shaft 12 and a sliding sleeve 14 that is longitudinally movable on the valve shaft 12 and by means of a coil spring 15 is supported against a holding sleeve 16 fastened at the valve shaft 12. Between the sliding sleeve 14 and the holding sleeve 16, a short distance b is provided in order to permit an elastic balancing of tolerances between the armature lift a2 and the valve lift s of the poppet valve 17. At the upper end of the valve shaft 12, a damping sleeve 18 is fastened that, when the poppet valve is closed, penetrates into the oil-filled damping cylinder 19 developed in the cylinder head, several damping disks 20 being disposed in said damping cylinder 19.

During operation of the device, damping sleeve 18 displaces the oil into the oil inlet bore 21 as well as into the throttling gap 22. By means of this damping device, a noise reduction of the valve drive and a reduction of wear at the valve disk 23 and the seat ring 24 are achieved. The degree of damping can be adjusted by the oil inlet pressure and the dimensioning of the throttling gap.

A good bearing of the valve control lever 11 is important for a precise valve control. For this purpose, it is, at its end face, developed as a bearing tube 25 having two radially projecting collars. The bearing tube 25, on both sides, is disposed in a bearing block 27 and 28 screwed onto the cylinder head 1; the collars 26 that rest against the bearing blocks 27, 28 on the front face secure the bearing tube 25 with respect to axial shifting.

In the area of one bearing block 27, in the bearing tube 25, one end of a cylindrical torsion bar spring 29 is fastened by means of a serrated connection 30. The other end of the torsion bar spring 29, also by means of a serrated connection 30, is torsionally fixed in a holding bush 31 that is provided with elongated holes 32 and is flanged onto the cylinder head 1. The distance cl from the coupling point of the armature 5 at the valve control lever to the longitudinal axis of the poppet valve 17 is shorter than the distance c2 to the center of the bearing of the valve lever 11 in order to be able to carry out a path translation from the armature lift a2 to the valve lift s. In the illustrated closed position of the poppet valve 17, the electromagnet 3 is excited. It attracts the armature disk 6 and holds the torsion bar spring 29 under tension.

For the opening of the poppet valve 17, the electromagnet 3 is de-energized and at the same time, the electromagnet 4 is excited. However, because of the large distance a2 it cannot yet exercise any noticeable force on the armature disk. The initial movement for the opening of the poppet valve is caused by the tensioned torsion bar spring 29 from which the tension is removed only at the half point of the armature lift. Starting from here, the armature disk 6, by means of the progressively rising magnetic force of the electromagnet 4 as well as the inertia force of the valve mechanism, is placed against the electromagnet 4, whereupon the poppet valve 17 goes into the open position and the torsion bar spring 29 is tensioned again, this time in the other rotating direction.

When the poppet valve 17 is closed, the just described process is repeated in the reversed sequence. The adjusting force, in this case, is applied to the poppet valve via the sliding sleeve and the coil spring. The elastic actuating ensures a simultaneous placing of the armature disk against the electromagnet and of the valve disk against the seat ring, also in cases when tolerance deviations of the distance a2 and of the valve lift s occur that are caused by manufacturing or temperature.

Figure 2:
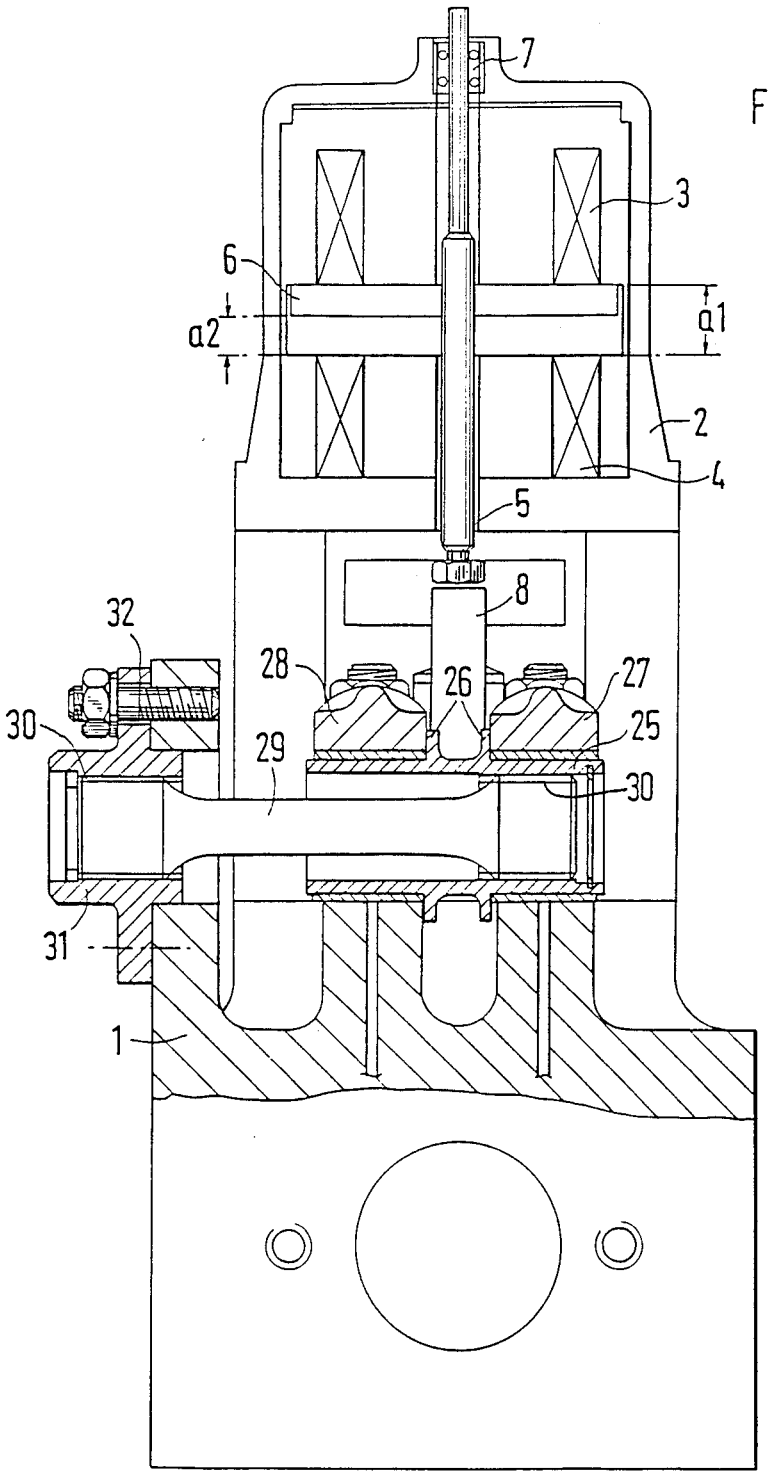
FIG. 2 is a lateral schematic view of the valve control device of FIG. 1, with a longitudinal sectional view through the bearing of the torsion bar spring.
Figure 3:
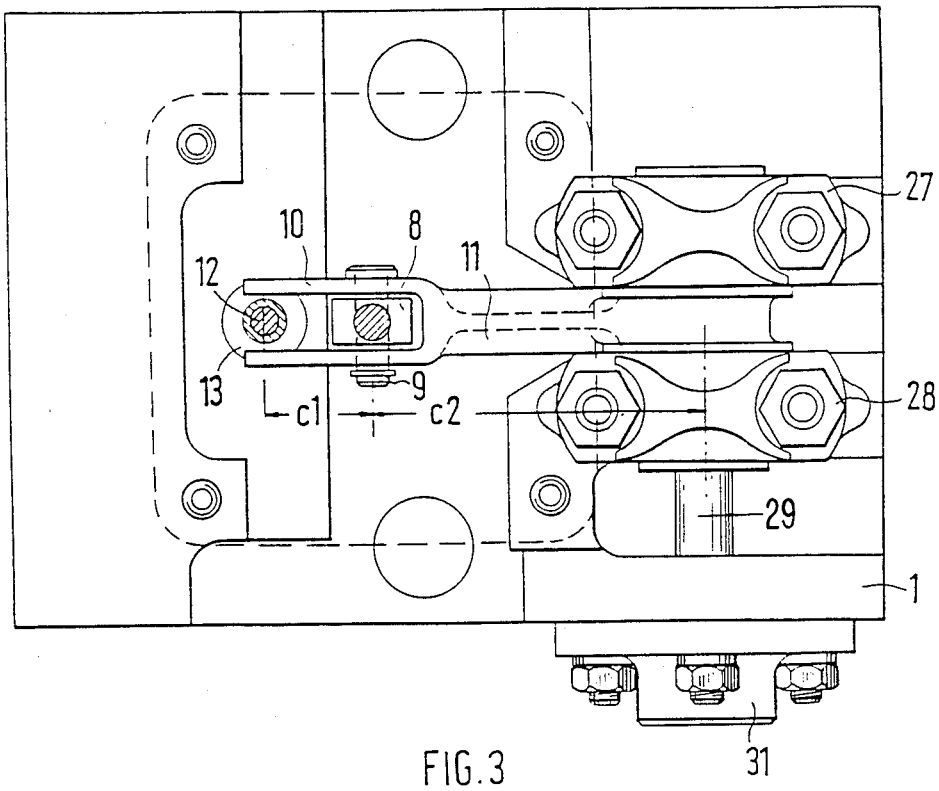
FIG. 3 is a top view of the valve control device of FIGS. 1 and 2.
Figure 4:
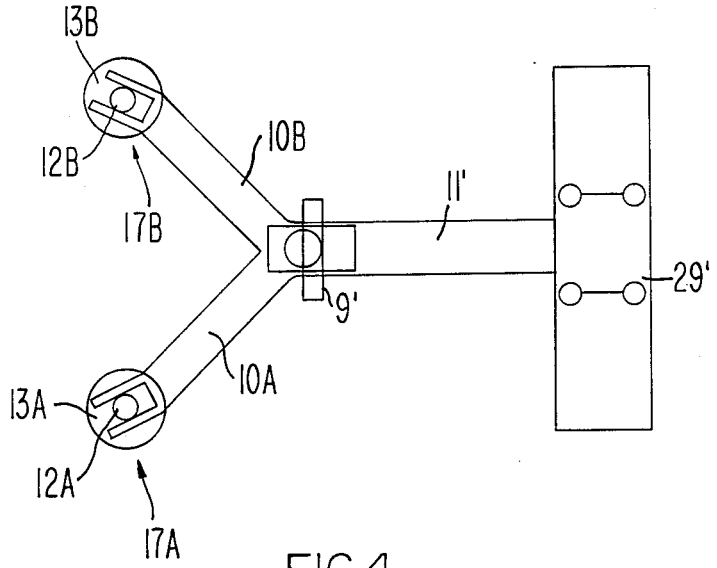
FIG. 4 is a schematic representation of an embodiment for simultaneously actuating two poppet valves.

FIG. 4 schematically depicts an arrangement for simultaneously actuating two poppet valves 17A and 17B with the corresponding valve shafts 12A, 12B and pressure disks 13A and 13B. FIG. 4 is a schematic top view similar to FIG. 3, and shows the parts for 10A, 10B for acting on the valve shaft pressure disks 13A and 13B in a manner corresponding to that described above the embodiment of FIGS. 1–3. Connection 9', control lever 11', and torsion bar spring 29' correspond respectively to the parts 9, 11, and 29 of the FIG. 1–3 embodiment.

Although the present invention has been described and illustrated in detail, it is to be clearly understood that the same is by way of illustration and example only, and is not to be taken by way of limitation.

What is claimed:

1. A device for actuating a fuel-exchange poppet valve of a reciprocating combustion engine, comprising:

a pivotable valve control lever having a first movable portion engageable with a poppet valve shaft of a poppet valve to move the poppet valve between open and closed positions in response to pivotal movement of the valve control lever about its bearing center;

movable armature means connected to a second portion of the valve control lever;

electromagnetic means for selectively moving the armature means to thereby forcibly pivotably move the valve control lever between respective open and closed positions of the poppet valve; and torsion bar spring means connected to the valve control lever for resiliently resisting movement of the valve control lever from an unstressed position of the torsion bar spring means toward both the respective open and closed positions of the poppet valve.

2. A device according to claim 1, wherein the first movable portion of the valve control lever is at a free end of the valve control lever, wherein the armature means is pivotally connected to the second portion of the valve control lever by means of an armature pivotal connection disposed between the free end and a bearing center pivotal connection of the valve control lever at its opposite end, and wherein the torsion bar spring means has one portion fixed to the pivotal bearing center of the valve control lever and another portion fixed to a fixed vehicle engine part.

3. A device according to claim 2, wherein the distance between the coupling joint of the armature to the longitudinal axis of the poppet valve is shorter than the distance between the coupling joint and the bearing center of the valve lever.

4. A device according to claim 2, wherein the valve lever is formed as a fork means that extends from its free end to slightly beyond the joint armature privotal connection.

5. A device according to claim 4, wherein the fork means is applied at the poppet valve rigidly in its opening direction and elastically in its closing direction.

6. A device according to claim 5, wherein the fork means, in closing direction of the poppet valve, rests against a sliding sleeve that is guided longitudinally on the poppet valve shaft, said sliding sleeve, being supported by means of a coil spring at a holding sleeve fastened on the poppet valve shaft, said sliding sleeve and said holding sleeve being a short distance from one another.

7. A device according to claim 2, wherein the closing movement of the poppet valve is dampened by a hydraulic damping device.

8. A device according to claim 7, wherein the damping device includes a damping sleeve that is fastened at an end face on the poppet valve shaft, an oil-filled damping cylinder equipped with damping disks, an oil inlet bore, and throttling gaps.

9. A device according to claim 2, wherein the valve control lever is formed as a bearing tube on its bearing center end, said bearing tube being disposed in bearing blocks at both its sides.

10. A device according to claim 9, wherein the torsion bar spring projects with one of its ends through the bearing tube and is connected with the bearing tube in the area of one bearing block in a torsionally fixed way.

11. A device according to claim 10, wherein the torsion bar spring with its other end remote from the valve control lever is clamped into a holding bush in a torsionally fixed way, said holding bush being flanged onto a cylinder head of an engine.

12. A device according to claim 11, wherein a rotating position of the holding bush can be adjusted by a swiveling in elongated holes.

13. A device according to claim 2, wherein said valve control lever is developed for a simultaneous actuating of two poppet valves.

14. A device according to claim 4, wherein said valve control lever is developed for simultaneous actuating of two poppet valves.

15. A device according to claim 7, wherein said valve control lever is developed for simultaneous actuating of two poppet valves.

16. A device according to claim 12, wherein said valve control lever is developed for simultaneous actuating of two poppet valves.

17. A device for actuating a fuel-exchange poppet valve of a reciprocating combustion engine, comprising:

a pivotable valve control lever having a first movable portion engageable with a poppet valve shaft of a poppet valve to move the poppet valve between open and closed positions in response to pivotal movement of the valve control lever about its bearing center;

movable armature means connected to a second portion of the valve control lever;

electromagnetic means for selectively moving the armature means to thereby forcibly pivotably move the valve control lever between the respective open and closed positions of the poppet valve; and torsion bar spring means connected to the valve control lever for resiliently resisting movement of the valve control lever toward the respective open and closed positions of the poppet valve;

wherein the first movable portion of the valve control lever is at a free end of the valve control lever, wherein the armature means is pivotally connected to the second position of the valve control lever by means of an armature pivotal connection disposed between the free end and a bearing center pivotal connection of the valve control lever at its opposite end, and wherein the torsion bar spring means has one portion fixed to the pivotal bearing center of the valve control lever and another portion fixed to a fixed vehicle engine part; and wherein the distance between the coupling joint of the armature to the longitudinal axis of the poppet valve is shorter than the distance between the coupling joint and the bearing center of the valve lever.

18. A device for actuating a fuel-exchange poppet valve of a reciprocating combustion engine, comprising:

a pivotable valve control lever having a first movable portion engageable with a poppet valve shaft of a poppet valve to move the poppet valve between open and closed positions in response to pivotal movement of the valve control lever about its bearing center;

movable armature means connected to a second portion of the valve control lever;

electromagnetic means for selectively moving the armature means to thereby forcibly pivotably move the valve control lever between respective open and closed positions of the poppet valve; and torsion bar spring means connected to the valve control lever for resiliently resisting movement of the valve control lever toward the respective open and closed positions of the poppet valve;

wherein the first movable portion of the valve control lever is at a free end of the valve control lever, wherein the armature means is pivotally connected to the second position of the valve control lever by means of an armature pivotal connection disposed between the free end and a bearing center pivotal connection of the valve control lever at its opposite end, and wherein the torsion bar spring means has one portion fixed to the pivotal bearing center of the valve control lever and another portion fixed to a fixed vehicle engine part;

wherein the closing movement of the poppet valve is dampened by a hydraulic damping device; and wherein the damping device includes a damping sleeve that is fastened at an end face on the poppet valve shaft, an oil-filled damping cylinder equipped with damping disks, an oil inlet bore, and throttling gaps.

* * * * *